US006348852B1

(12) United States Patent
Kojima et al.

(10) Patent No.: US 6,348,852 B1
(45) Date of Patent: Feb. 19, 2002

(54) CHIP PTC THERMISTOR AND METHOD OF MANUFACTURING THE SAME

(75) Inventors: Junji Kojima, Hirakata; Kiyoshi Ikeuchi, Nishinomiya; Takashi Ikeda, Osaka; Koichi Morimoto, Sakai; Toshiyuki Iwao, Hirakata, all of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/807,180

(22) PCT Filed: Oct. 12, 1999

(86) PCT No.: PCT/JP99/05601

§ 371 Date: Jun. 7, 2001

§ 102(e) Date: Jun. 7, 2001

(87) PCT Pub. No.: WO00/22631

PCT Pub. Date: Apr. 20, 2000

(30) Foreign Application Priority Data

Oct. 13, 1998 (JP) ..... 10-290337

(51) Int. Cl.[7] ..... H01C 7/10; H01C 7/13

(52) U.S. Cl. ..... 338/22 R; 338/309; 338/332; 338/29; 338/610.1

(58) Field of Search ..... 338/22 R, 307, 338/308, 309, 21, 332; 29/610.1, 312

(56) References Cited

U.S. PATENT DOCUMENTS 5,699,607 A * 12/1997 McGuire et al. ..... 29/612
6,157,289 A * 12/2000 Kojima et al. ..... 338/22 R
6,172,591 B1 * 1/2001 Barrett ..... 338/22 R
6,188,308 B1 * 2/2001 Kojima et al. ..... 338/22 R

FOREIGN PATENT DOCUMENTS

| | | |
|---|---|---|
| JP | 61-10203 | 1/1986 |
| JP | 4-346409 | 12/1992 |
| JP | 6-267709 | 9/1994 |

* cited by examiner

*Primary Examiner*—Karl D. Easthom
*Assistant Examiner*—Kyung S. Lee
(74) *Attorney, Agent, or Firm*—Parkhurst & Wendel, L.L.P

(57) ABSTRACT

The PTC thermistor chip of the present invention comprises a conductive polymer having PTC properties, a first outer electrode, a second outer layer electrode, not less than one inner electrode sandwiched between the conductive polymer, a first electrode electrically directly coupled with the first outer electrode, and a second electrode disposed electrically independently from the first electrode. When counting from one of the inner electrodes closest to the first outer layer electrode, and defining the inner layer electrode in a "n"th position as the "n"th inner electrode, the odd-numbered inner layer electrodes are directly coupled with the second electrode and the even-numbered inner layer electrodes, with the first electrode. In this PTC thermistor, the cross sections where the odd-numbered and even numbered inner electrodes are respectively in contact with the second and first electrodes are thicker than the other sections.

10 Claims, 11 Drawing Sheets

(a) PRIOR ART (b) PRIOR ART

CHIP PTC THERMISTOR AND METHOD OF MANUFACTURING THE SAME

FIELD OF THE INVENTION

The present invention relates to a chip positive temperature coefficient (hereinafter, PTC) thermistor comprising conductive polymers having PTC properties. The present invention particularly relates to a laminated chip PTC thermistor and a method of manufacturing the same.

BACKGROUND OF THE INVENTION

PTC thermistors have been used as an overcurrent protection element. When an electric circuit gets overloaded, conductive polymers of a PTC thermistor, which have PTC properties, emit heat and thermally expand to become high resistance, thereby reducing the current in the circuit to a safe small current level.

The following is a description of a conventional laminated chip PTC thermistor (hereinafter, PTC thermistor).

Conventional PTC thermistors include those disclosed in the Japanese Patent Application Laid Open Publication No. S61-10203 in which a thermistor is constructed such that a plurality of conductive polymer sheets and metal foils are alternately laminated and terminals are provided on opposite side faces.

FIG. 11(*a*) is a cross section of a conventional PTC thermistor. FIG. 11(*a*) shows conductive polymer sheets (hereinafter, polymer sheet) 1*a*, 1*b* and 1*c*. Electrodes 2*a*, 2*b*, 2*c* and 2*d* sandwich the polymer sheets 1*a*, 1*b* and 1*c* such that openings 3 are formed on alternate sides of the electrodes 2*a*, 2*b*, 2*c* and 2*d*. By layering these electrodes 2*a*, 2*b*, 2*c* and 2*d*, and the polymer sheets 1*a*, 1*b* and 1*c* alternately, a laminate 4 is formed. On side faces of the laminate 4 are terminals 5*a* and 5*b*.

However, the construction of the conventional PTC thermistor has problems: due to the considerably large differences in thermal expansion coefficients between the component materials, mechanical stress applied during operation of the PTC thermistor has caused cracks in and degraded the connection points between the electrodes 2*a*, 2*b* and 2*c* and the terminals 5*a* and 5*b*. In some severe cases, such degradation resulted in breaking of wires Furthermore, since terminals 5*a* and 5*b* fail to extend either to the bottom face of the polymer sheet 1*c* or to the top face of the polymer sheet 1*a*, the PTC thermistor can not be mounted on a flat surface. To address this problem, the terminals 5*a* and 5*b* need to be extended to the lowest point of the polymer sheet 1*c* and the highest point of the polymer sheet 1*a* respectively. FIG. 11(*b*) shows a cross section of a PTC thermistor which has been modified as mentioned above and soldered on a printed circuit board. In this construction, when the PTC thermistor is soldered on the printed circuit board, large differences in the thermal expansion coefficients among the polymer sheets 1*a*, 1*b* and 1*c*, the electrodes 2*a*, 2*b*, 2*c*, and 3*d*, and the terminals 5*a* and 5*b* cause the terminal 5*a* in particular to be distorted. Due to this distortion, when the soldering is carried out stress remains on the bonded surfaces between the terminal 5*a* and the polymer sheet ic and the contact section between the terminal 5*a* and the electrode 2*c*. The PTC thermistor serves as a protection device against overload: its conductive polymers expand under heat and become a high resistance. While the PTC thermistor is in a protection operation, the thermal expansion of the polymer sheet 1*a*, 1*b* and 1*c* causes a significant mechanical stress. Repeated protection operations, namely, repeated expansion and shrinkage of the conductive polymers promote separation of the bonded surfaces between the terminal 5*a* and the polymer sheet 1*c*. Further, since stress concentrates on the connection point between the terminal and the electrode, the connection point suffers cracks, which in some cases, triggers breaking of wires.

The present invention aims at solving the foregoing problems of the conventional laminated PTC thermistors and providing a chip PTC thermistor which does not suffer cracks in the connection sections between the inner electrodes and side electrodes, achieve a long-term reliable connection and is suitable for surface mounting.

SUMMARY OF THE INVENTION

The chip PTC thermistor of the present invention comprises:

a) a conductive polymer having PTC properties;

b) a first outer electrode in contact with the conductive polymer;

c) a second outer electrode sandwiching the conductive polymer with the first outer layer electrode;

d) one or more inner electrode disposed in between and parallel to the first and second outer electrodes and sandwiched between the conductive polymer;

e) a first electrode electrically directly coupled with the first outer electrode; and f) a second electrode disposed electrically independently from the first electrode.

Where, when counting from one inner electrode, which is the closest to the first outer electrode, an inner electrode in "n"th position is called as the "n"th inner electrode. And when "n" is an odd-number, the inner electrodes are directly coupled with the second electrode, and when "n" is an even-number, the inner electrodes, with the first electrode. If the total number of the inner electrodes is an odd number, the second outer electrode is electrically directly coupled with the first electrode, and if the total number of the inner electrodes is an even number, with the second electrode. In this PTC thermistor, the cross sections where the odd-numbered inner electrodes are coupled with the second electrode are thicker than the other sections, and the cross sections where the even numbered inner electrodes are coupled with the first electrode are thicker than the other sections.

According to this construction, even if repeated expansion and shrinkage of the conductive polymers impose stress, connection points between inner electrodes and side face electrodes do not suffer cracks. Thus, the PTC thermistor of the present invention achieves a superior long-term connection reliability and is suitable for surface mounting.

BRIEF DESCRIPTION OF THE DRAWINGS

FIG. 1(*b*) is a sectional view sectioned at the A—A' line of FIG. 1(*a*).

FIG. 11(*b*) is a sectional view of a conventional three-layered PTC thermistor for surface mounting.

DETAILED DESCRIPTION OF THE PREFERRED EMBODIMENTS

The First Preferred Embodiment

The surface PTC thermistor of the first preferred embodiment of the present invention is described hereinafter with reference to the accompanying drawings. The inner electrode of the first embodiment is single.

Figure 1:
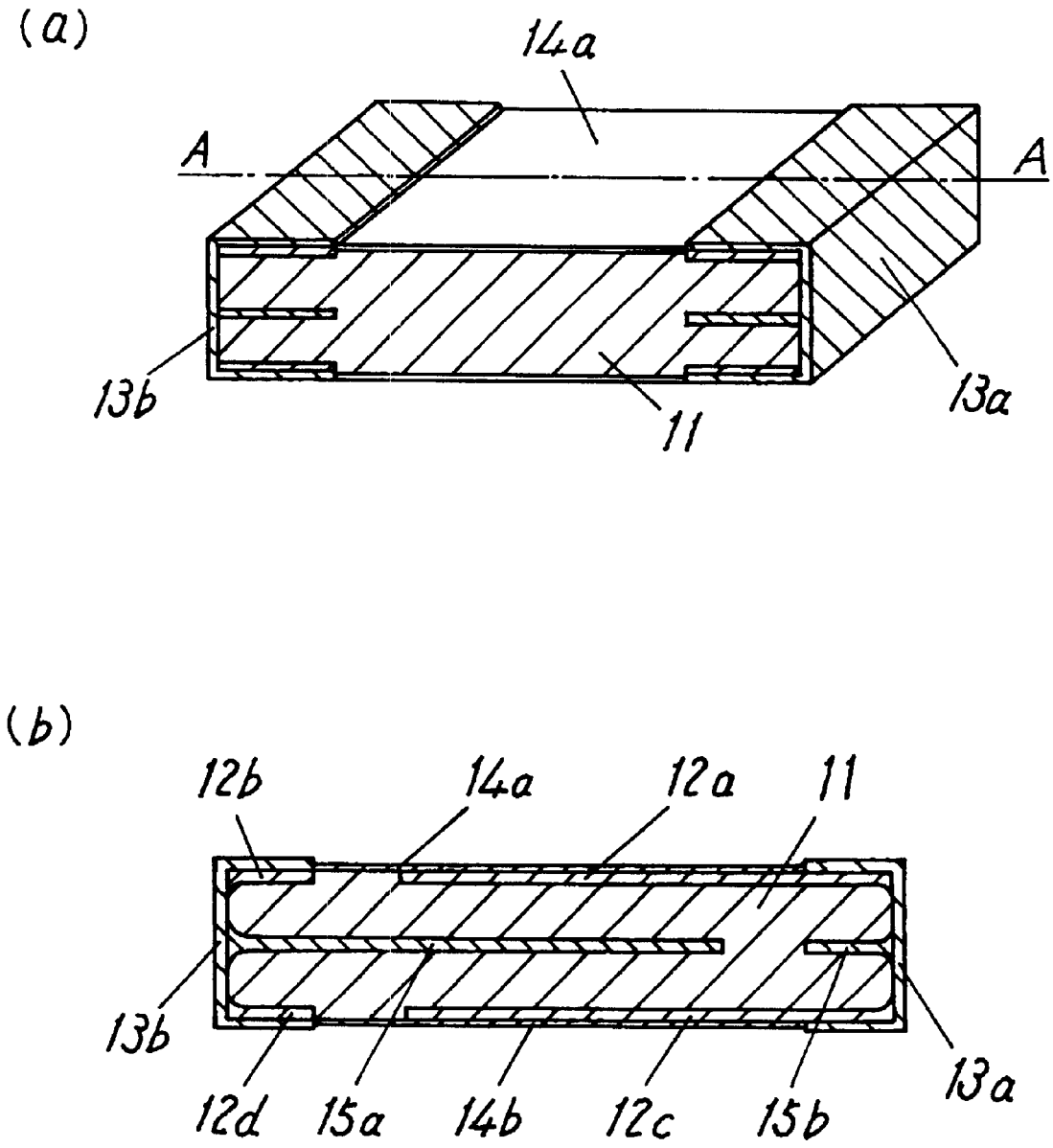
FIG. 1(*a*) is a perspective view of a PTC thermistor in accordance with a first preferred embodiment of the present invention.

In FIGS. 1(*a*) and (*b*), a conductive polymer 11 with PTC properties comprises a mixture of a high density polyethylene which is one of crystalline polymers, and carbon black. A first outer electrode 12*a* is disposed on a first face of the conductive polymer 11, and a first sub electrode 12*b* is disposed independently on the same face as the first main electrode. A second outer electrode 12*c* is disposed on a second face opposite the first face of the conductive polymer 11, and a second sub electrode 12*d* is independently disposed on the same face as the second main electrode 12*c*. All of these electrodes 12*a*, 12*b*, 12*c*, and 12*d* comprise electrolytic copper foil. A first side electrode 13*a* made with a nickel plating layer is disposed over the entire surface of one of the side faces of the conductive polymer 11. The first side electrode 13*a* electrically couples the outer electrodes 12*a* and 12*c*. A second side electrode 13*b* made with a nickel plating layer is disposed over the entire surface of the other side face of the conductive polymer 11. The second side electrode 13*b* also electrically couples the sub electrodes 12*b* and 12*d*. First and second protective coats 14*a* and 14*b* comprise epoxy modified acrylic resins. An inner main electrode 15*a* is disposed in the conductive polymer 11 parallel to the outer electrodes 12*a* and 12*c*, and electrically coupled with the side electrode 13*b*. An inner sub electrode 15*b* is independently disposed on the same face as the inner main electrode 15*a*, and electrically coupled with the side electrode 13*a*.

The manufacturing method of the PTC thermistor constructed in the foregoing manner, is described with reference to the accompanying drawings.

Figure 2:
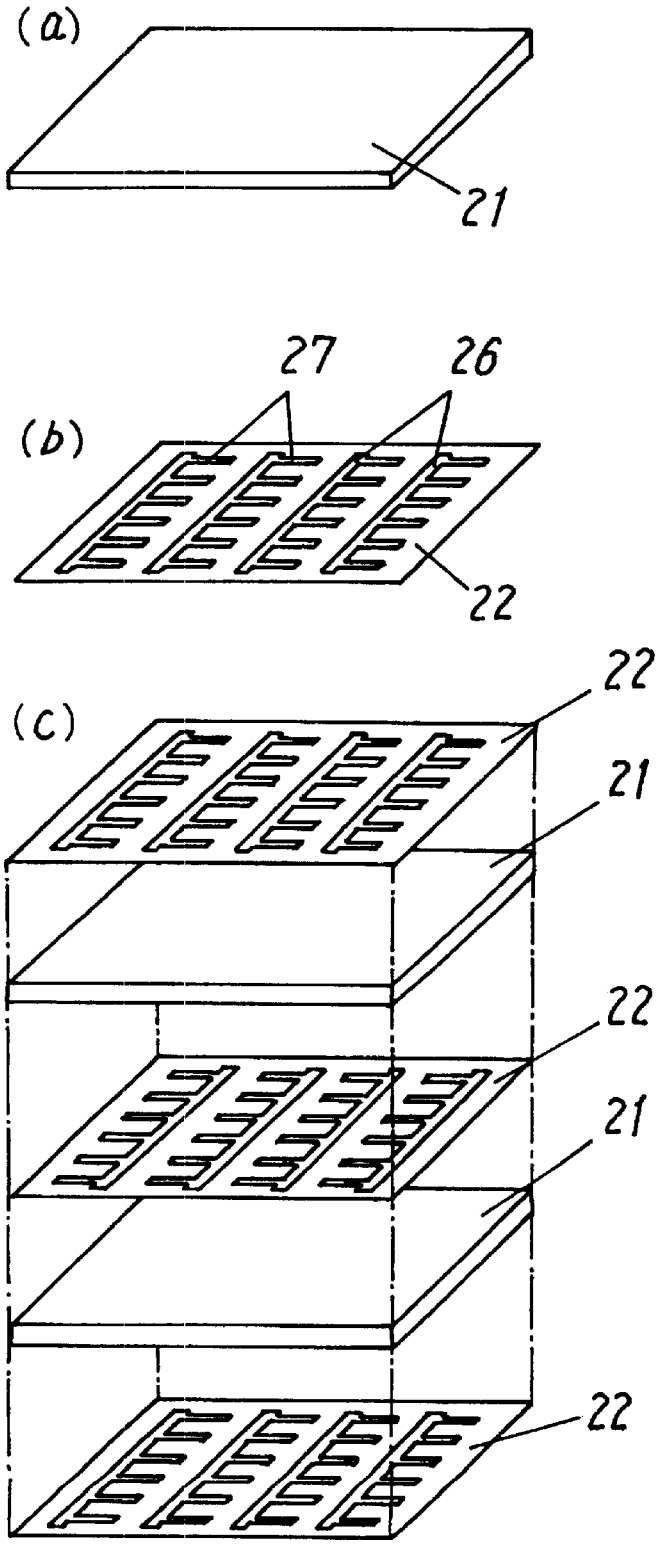
FIGS. 2(*a*)–(*c*) are flow diagrams showing manufacturing method of the PTC thermistor of the first preferred embodiment.
Figure 3:
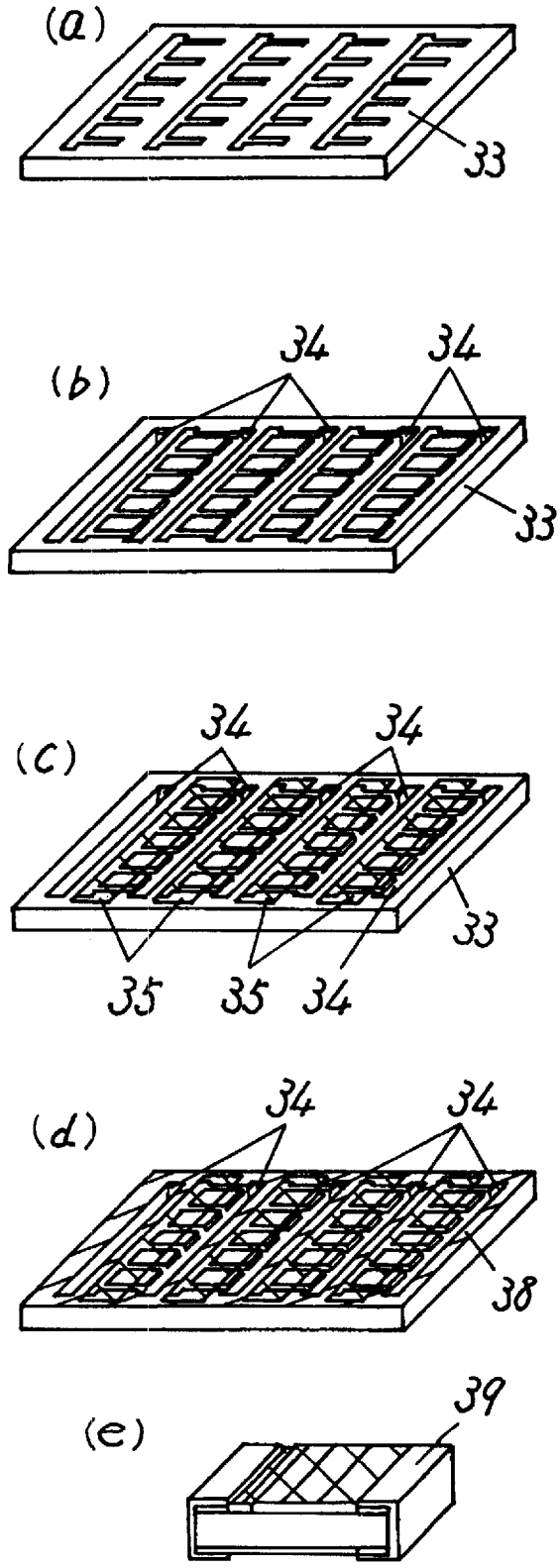
FIGS. 3(*a*)–(*e*) are flow diagrams showing a manufacturing method of the PTC thermistor of the first preferred embodiment.

FIGS. 2(*a*)–(*c*) and FIGS. 3(*a*)–(*e*) are flow diagrams showing the manufacturing method of the PTC thermistor of the first preferred embodiment of the present invention.

A 0.16 mm thick, conductive polymer sheet 21 shown in FIG. 2(*a*) is manufactured first by mixing the following ingredients with a hot 2-roll mill at approximately 170° C. for about 20 minutes and drawing out the mixture from the 2-roll mill as a sheet.

a) 42 wt % of high density polyethylene of the crystallinity of 70–90% b) 57 wt % of furnace carbon black having an average particle diameter of 58 nm and specific surface area, 38 $m^2/g$ c) 1 wt % of anti-oxidant Subsequently, a comb-pattern is formed on an electrolytic copper foil by a metallic mold press to manufacture an electrode 22 shown in FIG. 2(*b*). Grooves 26 shown in FIG. 2(*b*) are formed to provide gaps between the main and sub electrodes so that they are separated at predetermined intervals from one another when they are divided into independent pieces. Grooves 27 prevent burrs on the electrolytic copper foil by reducing the amount of the electrolytic copper foil being cut during the dividing process. The grooves 27 also prevent the section of the electrolytic copper foil from being exposed to the outside and oxidized. They also prevent a short circuit resulting from soldering during a mounting process. The electrolytic copper foil for the inner electrodes should be at least 35 $\mu$m, and preferably, 70 $\mu$m or thicker to avoid tearing during pressing of the laminate under heat and pressure.

Subsequently, the conductive polymer sheets 21 and the electrodes 22 are layered alternately as shown in FIG. 2(*c*). The laminate is hot pressed by a vacuum hot press for one minute at 175° C., 20 torr, and a pressure of 75 $kg/cm^2$ to form an integrated sheet 33 shown in FIG. 3(*a*). Since the shape of the three electrodes in FIG. 2(*c*) can be formed the same, only one metallic mold is required for punching, thereby reducing the cost. However, as FIG. 2(*c*) shows, the electrodes 22 next to each other must be placed alternately in different directions.

The integrated sheet 33 is thermally processed at 110~120° C. for one hour and then electron beam irradiated at approximately 40 Mrad in an electron beam radiater to cross-link high density polyethylene.

Then, as FIG. 3(*b*) shows, narrow and long openings 34 are formed at predetermined intervals by dicing, such that some space is left between the longitudinal sides of a desired PTC thermistor.

The dicing conditions are as follows:

a) rotation of the wheel: 30000 rpm;

b) speed of feeding: 10 mm/s c) dicing blade: NBC-ZB series (product of Disco Co., Ltd) with a #320 mesh abrasive grains and the 0.2 mm thick blade.

Figure 10:
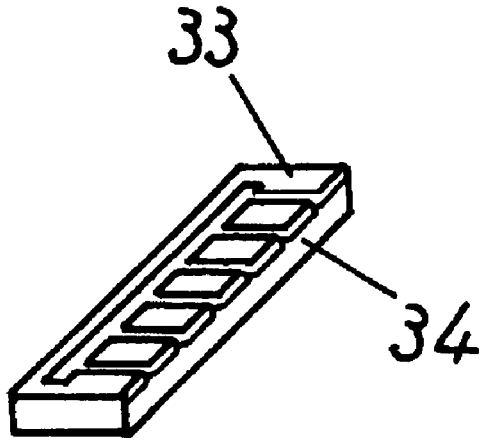
FIGS. 10(*a*) and (*b*) are perspective views of openings respectively with a shape of strip and comb.
Figure 10:
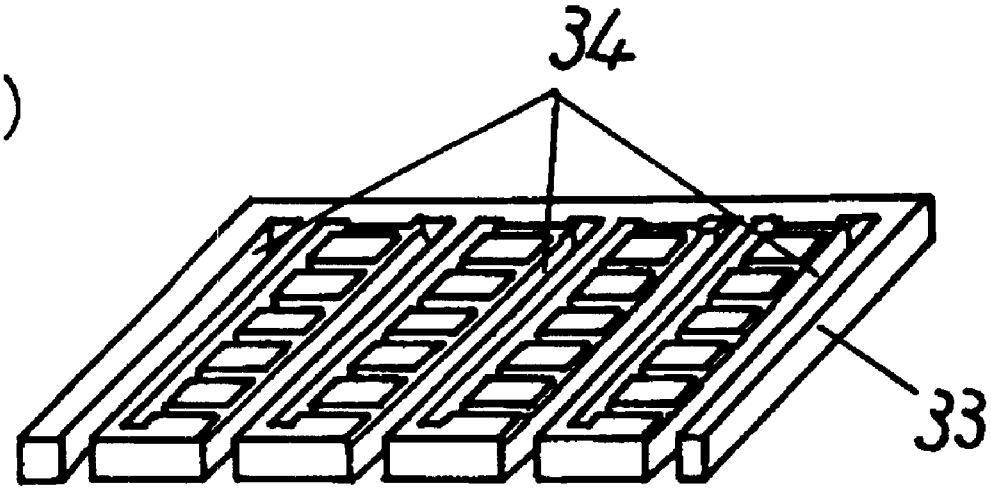
Figure 11:
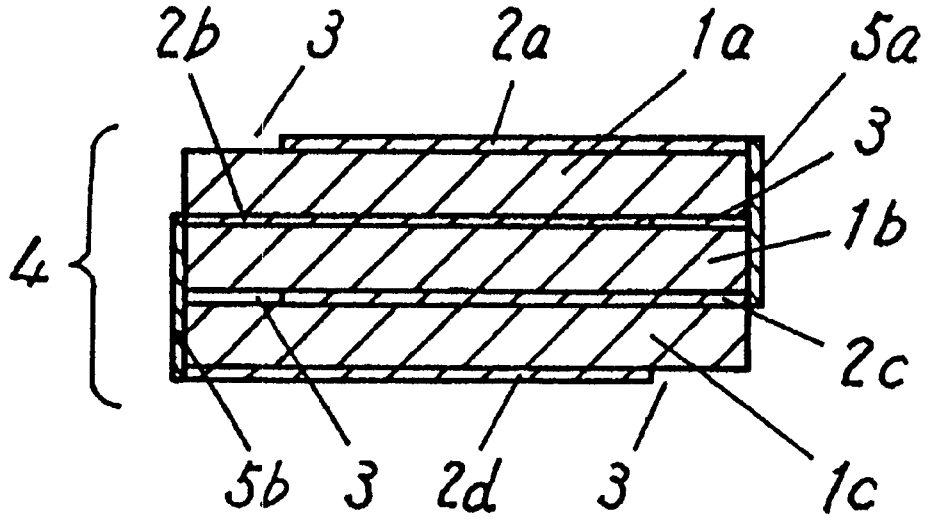
FIG. 11(*a*) is a sectional view of a conventional PTC thermistor.
Figure 11:
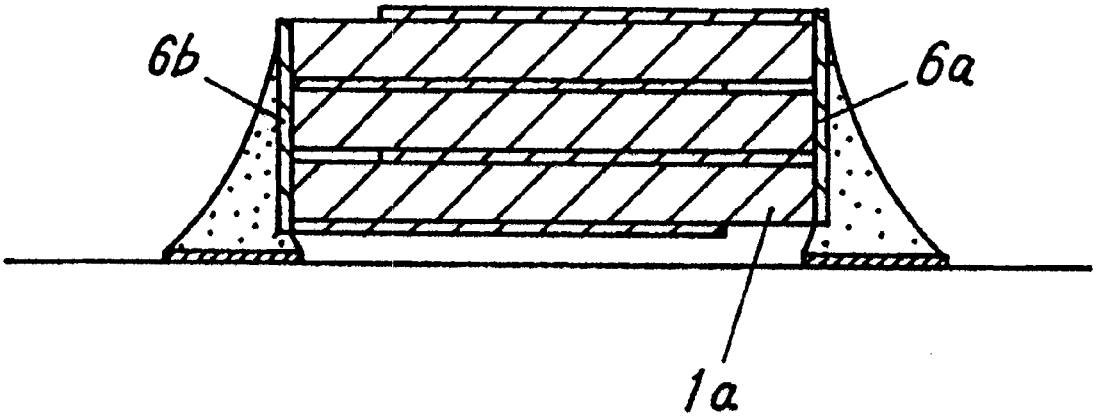

If the particle size of the abrasive grains is too small, cutting ability is reduced and the blade produces more heat. If the temperature of the conductive polymer rises to the melting point or higher due to the heat produced by the blade, the cross section of the polymer around the openings 34 is distorted significantly and the thickness of the sheet near the openings becomes uneven. The unevenness in the thickness leads to uneven polishing of the electrodes in the following polishing process. Therefore, abrasive grains should be larger than the mesh #600. If the feeding speed for dicing is extremely slow (0.5 mm/s), sagging of the metallic foil becomes insufficient, and connection reliability (to be mentioned later) is reduced. Conversely, if the feeding speed is too fast, the blade will start producing heat. Therefore, the feeding speed is preferably set at between 1 mm/s–50 mm/s. If the blade is too thin, it is easily distorted due to the resistance applied during cutting, lowering the precision of the cutting line. Therefore, to maintain the feeding speed of 10 mm/s or higher, the blade should be preferably 0.15 mm or thicker. The conditions of the first preferred embodiment prevent the cross section of the conductive polymer from distorting. According to these conditions, the contacting area between the inner electrodes and the side electrodes is desirably increased since the cross section of the metallic foil are increased by the sagging occurred during cutting. The process of forming the openings 34 can be modified as shown in FIGS. 10(*a*) and (*b*), so that the sheet 33 becomes strip or comb-shaped.

After forming the openings 34 shown in FIG. 3(*b*), the sheet 33 is polished by a #220 IH wheel (produced by Ishii-Hyoki Co., Ltd.) to remove burrs from its top and bottom faces.

Subsequently, as FIG. 3(*c*) shows, an epoxy-modified acrylic resin is screen printed on the top and bottom faces of the sheet 33 with the openings 34, with the exception of the vicinity of the openings 34. The sheet is then heat cured in a curing oven to form a protective coat 35.

In FIG. 3(*d*), the sheet 33 is then wholly immersed in a nickel sulfamate bath and plated under the current density of 4 A/dm$^2$ for about 40 minutes to coat the sections of the sheet 33, which are not coated with the protective coat 35, and inner walls of the openings 34 with a nickel plating of approximately 20 $\mu$m in thickness and form side electrodes.

The sheet 38 wholly coated with plating, shown in FIG. 3(*d*) is then diced into independent elements to form chip PTC thermistor 39 shown in FIG. 3(*e*).

In this embodiment, as the electrode in the outermost layer, a metallic foil with a pattern formed thereof is used. However, a metallic foil without a pattern can be used in the outermost layer and metallic foils with a pattern formed by a metallic mold press in other layers. In this case, the electrode on the outermost layer can be formed by (1) laminating metallic foils and a conductive polymer, (2) integrating the laminate under heat and pressure, (3) forming resist patterns on the metallic foil on the outermost layer by screen printing or photolithography, and (4) etching a pattern on the outermost electrode.

After forming the outer layer electrode, a similar PTC thermistor can be formed by following the same manufacturing process as the first preferred embodiment.

According to the first preferred embodiment of the present invention, since the openings 34 are formed by dicing, cross sections of the metallic foil of the inner layers can be increased by sags during cutting. Therefore, the area of the connection section with the side electrodes increases, and thus, improves the connection reliability between the inner electrodes and the side electrodes. The amount of sags during the cutting is such that when the thickness of the metallic foil is 90 $\mu$m, the height of the cross section is between 150 $\mu$m–180 $\mu$m. In other words, the area of the connection section is 1.6–2 times larger than the cross section without sags.

For comparison, samples are prepared by slowing down the speed of cutting (feeding speed 0.5 mm/s) to make the openings so as to reduce the amount of sags on the cross section of the metallic foil in the inner layers (the height of the section is 100 $\mu$m). 20 samples are mounted each on printed circuit boards to conduct trip cycle test. The test was conducted as an accelerated thermal expansion and shrinkage test. In the test, samples are connected to a DC power source of 6V and overcurrent of 40A is flown to trigger a protection operation (trip). The power source is kept on for 6 seconds and then turned off for 60 seconds. This cycle is repeated 6000 cycles in total, and at the 3000th and 6000th cycles, 10 samples each are taken out for evaluation.

No cracks are observed, after 6000 cycles, among 10 samples of the present invention, which have the openings 34 formed by dicing. On the other hand, 3 out of 10 comparative samples, which have small amount of sags on the cross section, suffered cracks in the connection sections between the side electrodes and the inner electrodes. This result suggests that area of the connection section significantly affects the reliability. In the first preferred embodiment, the dicing conditions are adjusted so that sectional area of the openings 34 becomes larger. Thus, the reliability of the connection sections is improved.

The Second Preferred Embodiment

Figure 4:
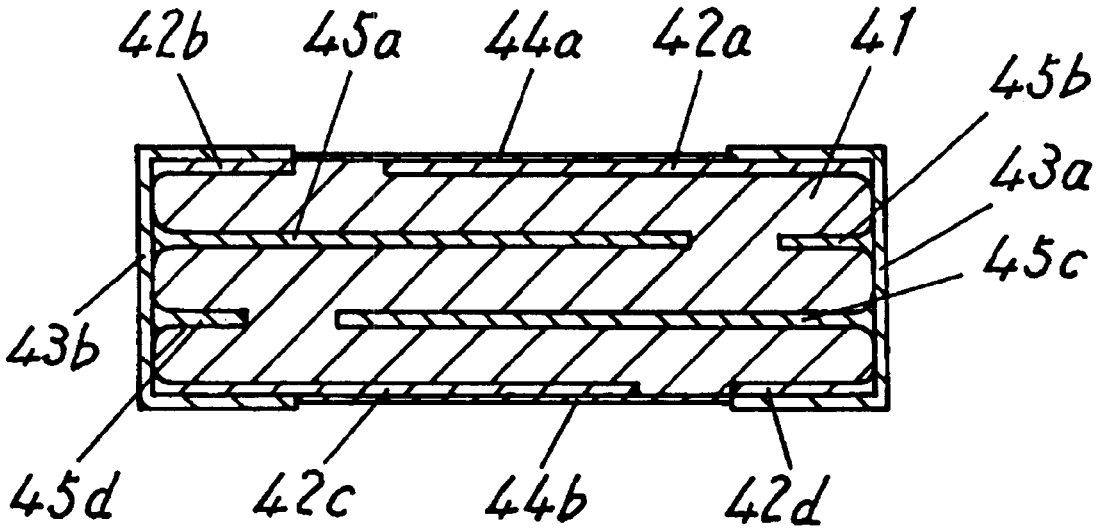
FIG. 4 is a sectional view of the PTC thermistor of a second preferred embodiment.

The PTC thermistor in the second preferred embodiment has two inner electrodes. FIG. 4 is a sectional view of the PTC thermistor of the second preferred embodiment.

In FIG. 4, a conductive polymer 41 comprises polymer with PTC properties and a mixture of a high density polyethylene and carbon black. A first outer electrode 42*a* is disposed on a first face of the conductive polymer 41, and a first sub electrode 42*b* is disposed separately on the same face as the electrode 42*a*. A second outer electrode 42*c* is disposed on a second face opposite the first face of the conductive polymer 41, and a second sub electrode 42*d* is separately disposed on the same face as the electrode 42*c*. All of these electrodes comprise electrolytic copper foil. A first side electrode 43*a* made with a nickel plating layer is disposed over the entire surface of one of side faces of the conductive polymer 41. The first side electrode 43*a* electrically couples the outer electrodes 42*a* and 42*d*. A second side electrode 43*b* made with a nickel plating layer is disposed over the entire surface of the other side face of the conductive polymer 41. The second side electrode 43*b* also electrically couples the electrodes 42*b* and 42*c*. First and second protective coats 44*a* and 44*b* comprise epoxy modified acrylic resins. A first inner main electrode 45*a* is disposed in the conductive polymer 41 parallel to the electrodes 42*a* and 42*c*, and electrically coupled with the side electrode 43*b*. A first inner sub electrode 45*b* is separately disposed on the same face as the electrode 45*a*, and electrically coupled with the side electrode 43*a*. A second inner main electrode 45*c* is disposed in the conductive polymer 41 parallel to the electrodes 42*a* and 42*c*, and electrically coupled with the side electrode 43*a*. A second inner sub electrode 45*d* is separately disposed on the same face as the electrode 45*c*, and electrically coupled with the side electrode 43*b*.

The manufacturing method of the chip PTC thermistor according to the second preferred embodiment of the present invention is described with reference to the accompanying drawings.

Figure 5:
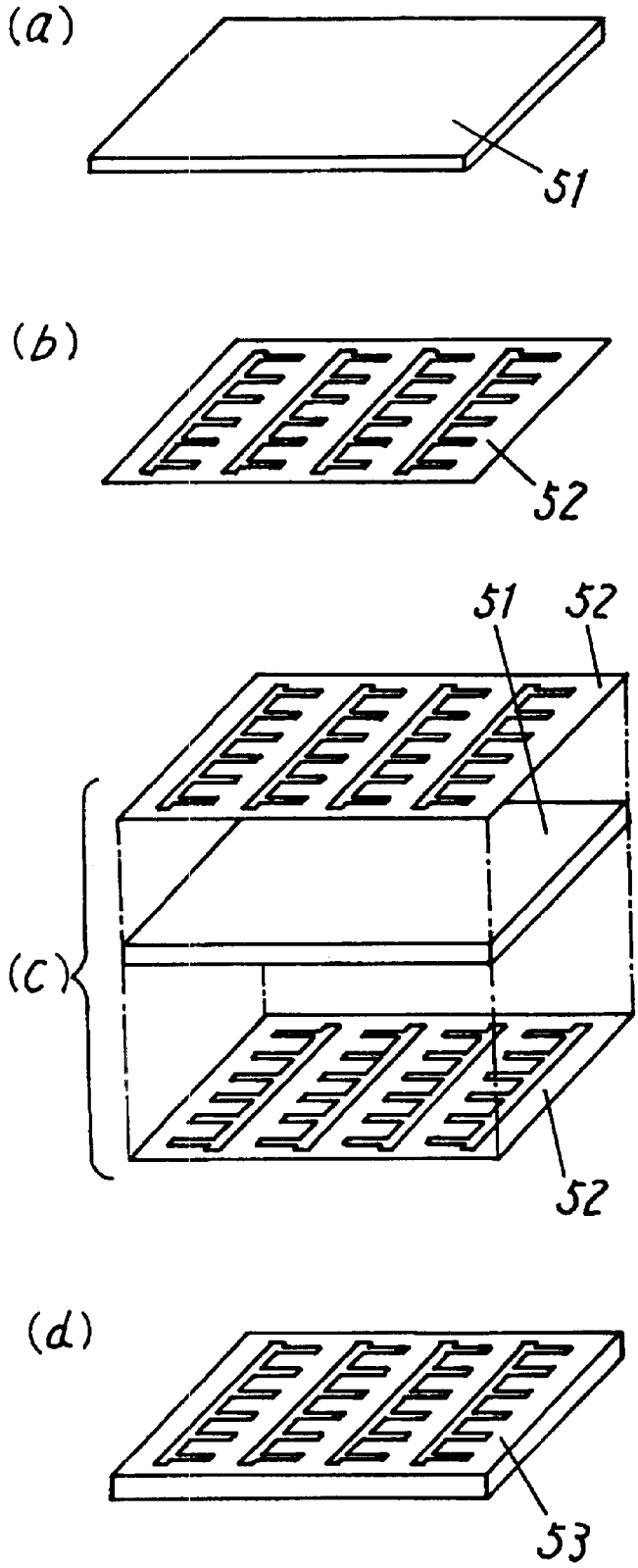
FIGS. 5(*a*)–5(*d*) are flow diagrams showing a manufacturing method of the PTC thermistor of the second preferred embodiment.
Figure 6:
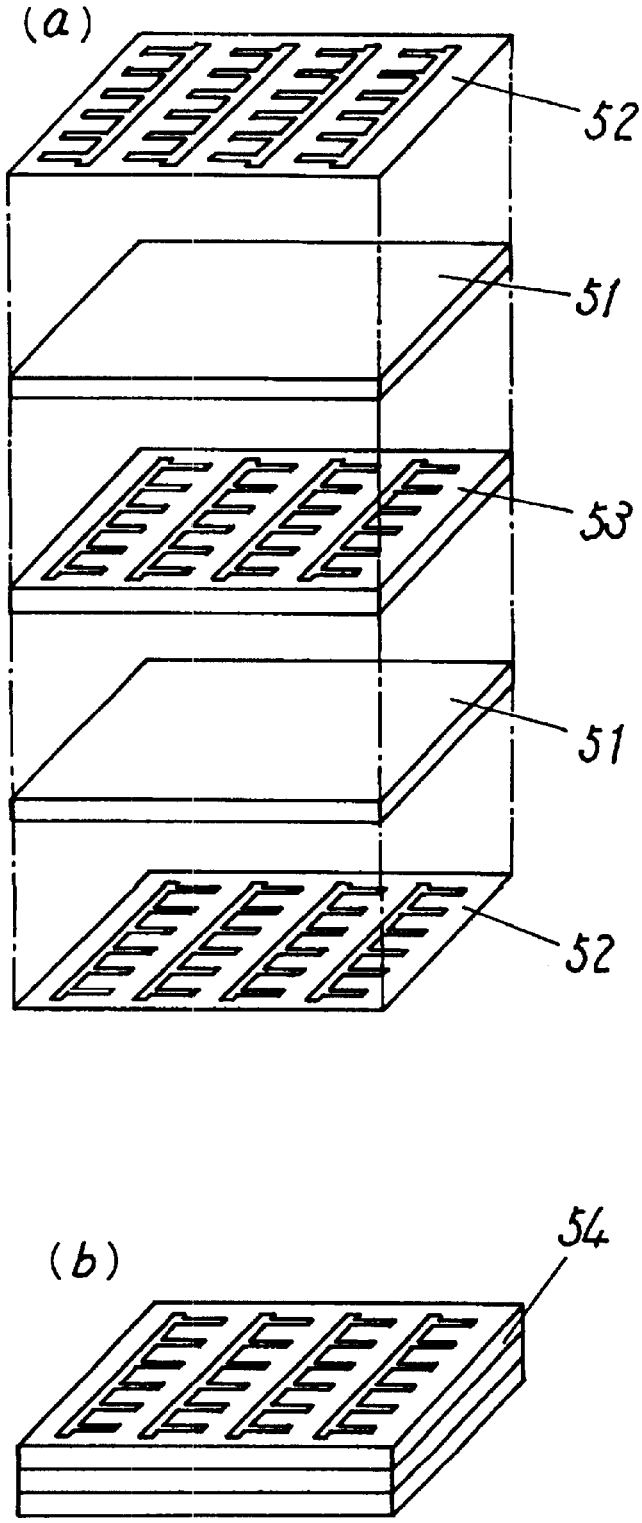
FIGS. 6(*a*) and (*b*) are flow diagrams showing a manufacturing method of the PTC thermistor chip of the second preferred embodiment.

FIGS. 5(*a*)–(*d*) and FIGS. 6(*a*) and (*b*) are flow diagrams showing the manufacturing method of the chip PTC thermistor in which three conductive polymers are layered. A conductive polymer sheet 51 and an electrode 52 shown in FIGS. 5(*a*) and (*b*) are prepared in the same manner as the first preferred embodiment. Similarly to the PTC thermistor with two layered laminate, electrolytic copper foil to be used in inner layers should be at least 35 $\mu$m, and preferably 70 $\mu$m in thickness so that it is not torn when the conductive polymer expand while pressing the laminate under heat and pressure in the following process. Two electrodes 52 and the conductive polymer 51 are layered and then pressed under heat and pressure to create an integrated first sheet 53 shown in FIG. 5(*d*). Then, the first sheet 53 is sandwiched between two conductive polymers 51 and then sandwiched between two electrodes 52 as shown in FIG. 6(*a*). The laminate is pressed under heat and pressure to prepare an integrated second sheet 54 shown in FIG. 6(*b*). The laminate undergoes the remaining processes the same as those of the first preferred embodiment, and a PTC thermistor with three layers of conductive polymers is produced.

In the second preferred embodiment, two pressing processes under heat and pressure are carried out. This is because, if the laminate is molded in one step, heat is not transferred to the inner conductive polymer thoroughly, and difference in temperature between the inner and outer conductive polymers may result in uneven thickness of the polymer sheet. The two pressing processes are taken to avoid such unevenness.

In this embodiment as well, metallic foil without pattern can be used in the outermost layer, and other metallic foil with pattern made with metallic press. These metallic foils and conductive polymers are pressed under heat and pressure to integrate them and form pattern on the metallic foil on the outermost layer to produce chip PTC thermistor. If the process of sandwiching the second sheet 54 between the conductive polymers and then between the electrodes with pattern formed thereon and pressing under heat and pressure is repeated, the PTC thermistor with odd numbers of layers of the conductive polymers more than five can be produced. In this case as well, if a metallic foil without pattern is used in the outermost layer, a pattern is formed by etching in the following process.

Samples of three layered chip PTC thermistor of the second preferred embodiment are prepared to conduct a trip cycle test. Trip cycle is repeated 6000 cycles, and at the 3000th and 6000th cycles, 10 samples each are taken out for evaluation. No cracks are observed, after 6000 cycles, among 10 samples with openings formed by dicing. This suggests that the expanded area of the connection section between the side electrodes and inner main electrodes similarly contributes to improvement of reliability in the three layered chip PTC thermistor.

The Third Preferred Embodiment

Figure 7:
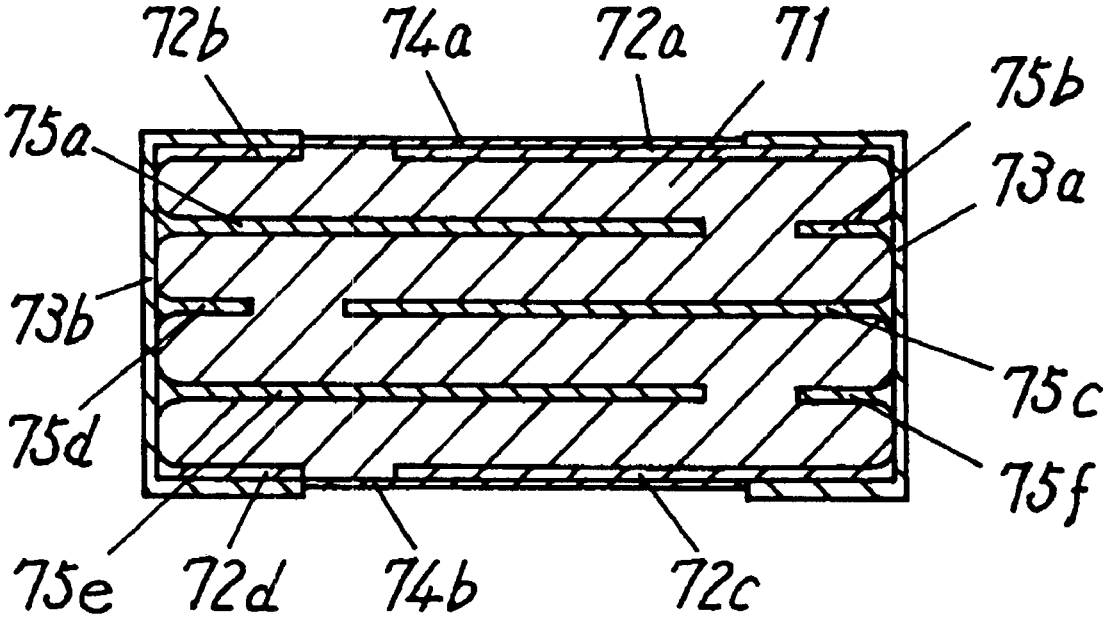
FIG. 7 is a sectional view of the PTC thermistor of a third preferred embodiment.

The PTC thermistor in the third preferred embodiment has three inner electrodes. FIG. 7 is a sectional view of the PTC thermistor of the third preferred embodiment.

In FIG. 7, a conductive polymer 71 comprises polymer with PTC properties and a mixture of a high density polyethylene and carbon black. A first main electrode 72*a* is disposed on a first face of the conductive polymer 71, and a first sub electrode 72*b* is disposed separately on the same face as the electrode 72*a*. A second outer electrode 72*c* is disposed on a second face of the conductive polymer 71, and a second sub electrode 72*d* is separately disposed on the same face as the electrode 72*c*. All of these electrodes comprise electrolytic copper foil. A first side electrode 73*a* made with a nickel plating layer is disposed over the entire surface of one of side faces of the conductive polymer 71. The first side electrode 73*a* electrically couples the main electrodes 72*a* and 72*c*. A second side electrode 73*b* made with a nickel plating layer is disposed over the entire surface of the other side face of the conductive polymer 71. The second side electrode 73*b* also electrically couples the sub electrodes 72*b* and 72*d*. First and second protective coats 74*a* and 74*b* comprise epoxy modified acrylic resins. A first inner main electrode 75*a* is disposed in the conductive polymer 71 parallel to the electrodes 72*a* and 72*c*, and electrically coupled with the side electrode 73*b*. A first inner sub electrode 75*b* is separately disposed on the same face as the electrode 75*a*, and electrically coupled with the side electrode 73*a*. A second inner main electrode 75*c* is disposed in the conductive polymer 71 parallel to the electrodes 72*a* and 72*c*, and electrically coupled with the side electrode 73*a*. A second inner sub electrode 75*d* is separately disposed on the same face as the electrode 75*c*, and electrically coupled with the side electrode 73*b*. A third inner main electrode 75*e* is disposed in the conductive polymer 71 parallel to the electrodes 72*a* and 72*c*, and electrically coupled with the side electrode 73*b*. A third inner sub electrode 75*f* is separately disposed on the same face as the electrode 75*e*, and electrically coupled with the side electrode 73*a*.

The manufacturing method of the chip PTC thermistor according to the third preferred embodiment of the present invention is described with reference to the accompanying drawings.

Figure 8:
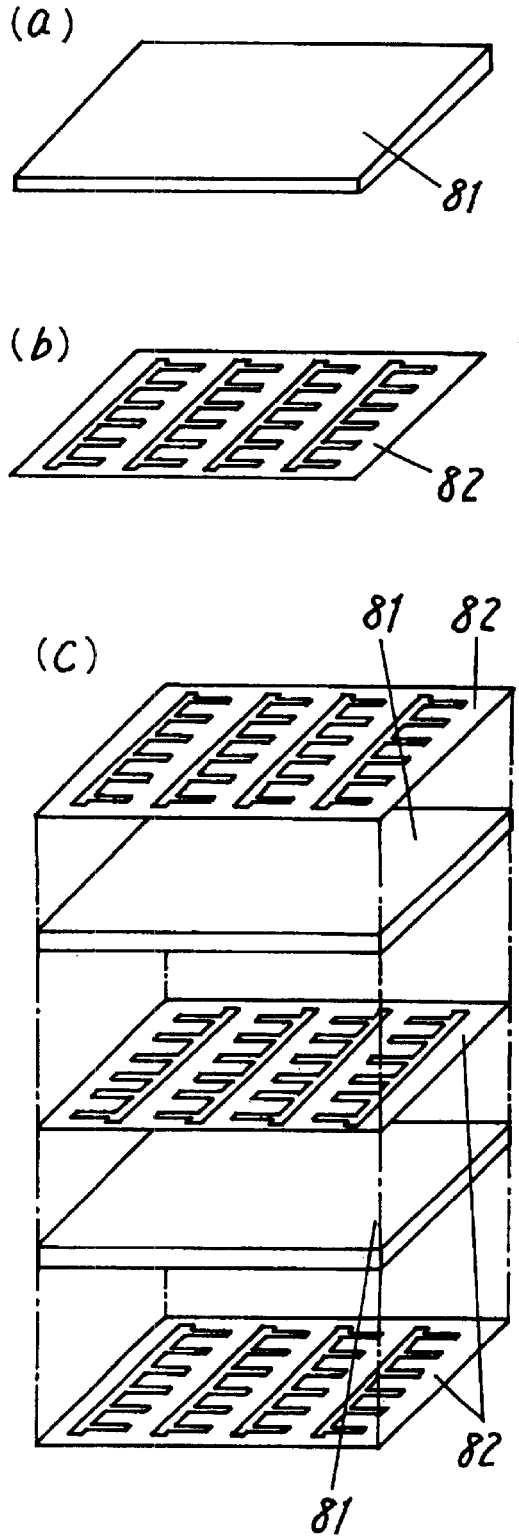
FIGS. 8(*a*)–(*c*) are flow diagrams showing a manufacturing method of the PTC thermistor of the third preferred embodiment.
Figure 9:
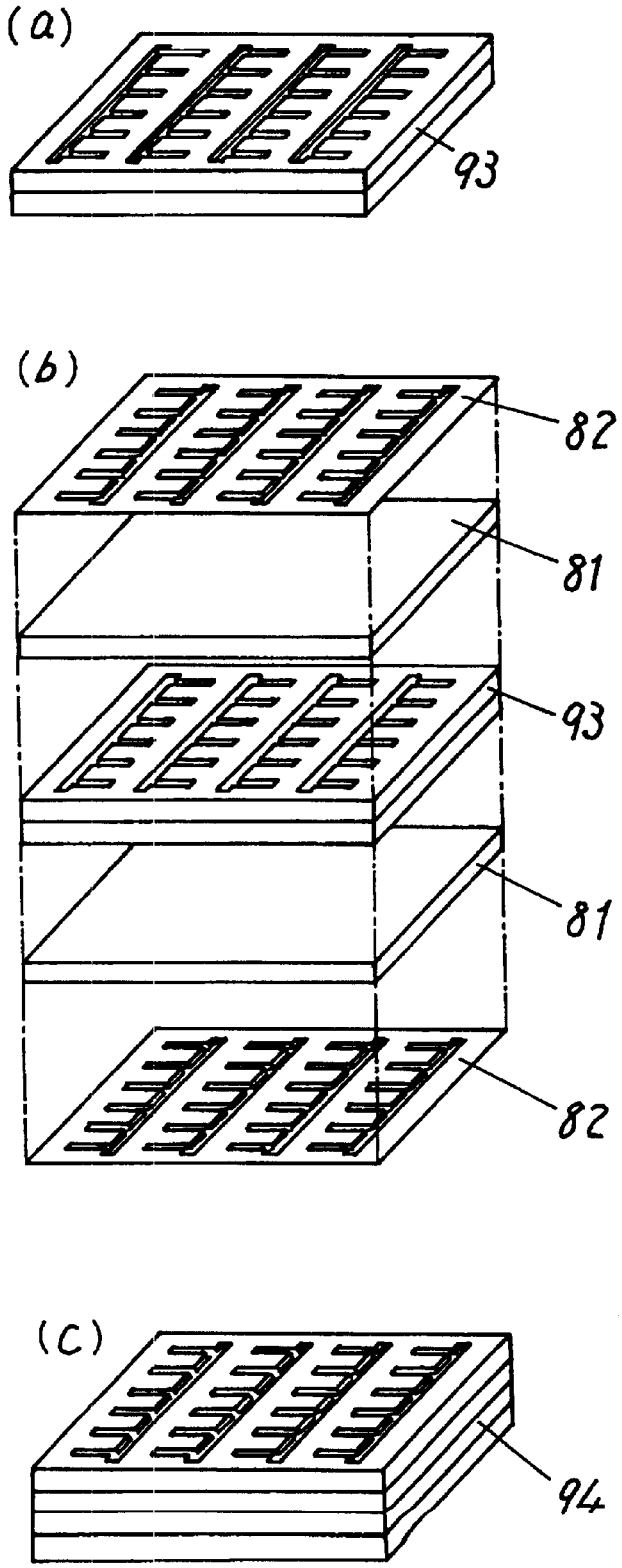
FIGS. 9(*a*)–(*c*) are flow diagrams showing a manufacturing method of the PTC thermistor of the third preferred embodiment.

FIGS. 8(*a*)–(*c*) and FIGS. 9(*a*)–(*c*) are flow diagrams showing the manufacturing method of the chip PTC thermistor in which four conductive polymers are layered. A conductive polymer sheet 81 and an electrode 82 shown in FIGS. 8(*a*) and (*b*) are prepared in the same manner as the first preferred embodiment. In a similar way to the PTC thermistor with a two layered laminate, electrolytic copper foil should be at least 35 μm, and preferably 70 μm in thickness. Three electrodes 82 and two conductive polymer 81 are layered such that the electrodes 82 are disposed outermost layers and then pressed under heat and pressure to create an integrated first sheet 93 as shown in FIG. 9(*a*). The first sheet 93 is sandwiched between two conductive polymers 81 and then sandwiched between two electrodes 82 as shown in FIG. 9(*b*). The laminate is pressed under heat and pressure to prepare an integrated second sheet 94 shown in FIG. 9(*c*). The laminate undergoes the remaining processes the same as those of the first preferred embodiment, and a PTC thermistor with four layers of conductive polymers is produced.

In this embodiment as well, metallic foil without pattern can be used in the outermost layer, and an other metallic foil with a pattern made with metallic press, and then by forming a pattern on the metallic foil on the outermost layer to produce a chip PTC thermistor.

If the process of sandwiching the second sheet 94 between the conductive polymers and then between the electrodes and pressing the laminate under heat and pressure is repeated, the PTC thermistor with even numbers of layers of more than six conductive polymers can be produced. In this case as well, if a metallic foil without a pattern is used in the outermost layer, a pattern is formed by etching in the following process.

As has been described, the number of layers of the conductive polymer can be increased. However, stress associated with the expansion and shrinkage of the conductive polymers due to its protective operation against the overload on the conductive polymer, increases as the number of the layers increases. This brings about a problem of connection reliability between the side electrodes and the inner main and sub electrodes. In the present invention, however, area of connection sections with the side electrodes is larger, therefore, the stress imposed on the connection sections is mitigated, thereby achieving sufficient connection reliability even when the number of layers increases.

In the foregoing preferred embodiments, as a crystalline polymer, high density polyethylene has been described, however, as easily understood from the foregoing operational mechanism, the present invention can be applied to any PTC thermistor using a crystalline polymer such as polyvinylidene fluoride, PBT resin, PET resin, polyamide resin, PPS resin and the like.

In the foregoing preferred embodiments, the openings 34 are mainly formed by dicing. However, the method of forming the openings 34 is not limited to this and can be formed by an other general processing method based on shearing, such as the use of metallic mold press.

INDUSTRIAL APPLICABILITY

According to the PTC thermistor of the present invention, the connection sections between the inner electrodes and the side electrodes are thicker than the other sections, thereby enhancing the strength of the connection sections. According to this construction, even if repeated expansions and shrinkage of the conductive polymers impose stress, connection sections between inner main and sub electrodes and side electrodes do not suffer cracks. Thus, the PTC thermistor of the present invention provides a superior long-term connection reliability and good surface mountability.

What is claimed is:

1. A chip PTC thermistor comprising:

a) a conductive polymer having PTC properties;

b) a first outer electrode in contact with said conductive polymer;

c) a second outer electrode sandwiching said conductive polymer with said first outer electrode;

d) one or more inner electrode disposed in between and parallel to said first and second outer electrodes and sandwiched between said conductive polymer e) a first electrode directly electrically coupled with said first outer electrode; and f) a second electrode disposed separately from said first electrode;

wherein when counting from one inner electrode, which is the closest to said first outer layer electrode, and defining an inner electrode located "n"th as a "n"th inner electrode, odd-numbered inner electrodes are directly coupled with said second electrode and even-numbered inner electrodes, with said first electrode, wherein when the total number of said inner electrodes is an odd number, said second outer electrode is electrically directly coupled with said first electrode, and if it is an even number, coupled with said second electrode, and wherein cross sections where said odd-numbered and even numbered inner electrodes are respectively coupled with said second and first electrodes are at least 1.3 times thicker than other sections.

2. The chip PTC thermistor as defined in claim 1, further comprising:

a) a first sub electrode located on a plane extended from said first outer electrode, electrically separated from said first outer electrode and directly coupled with said second electrode; and b) a second sub electrode located on a plane extended from said second outer electrode, separated from said second outer electrode and coupled with one of said first and second electrodes, which is electrically separated from said second outer electrode.

3. The chip PTC thermistor as defined in claim 1, further comprising an inner sub electrode located on a plane extended from said inner electrode, separated from said inner electrode, and when said inner layer electrode is even-numbered, coupled with said first electrode, and when odd-numbered, with said second electrode.

4. The chip PTC thermistor as defined in claim 3, wherein cross sections where said odd-numbered and said even numbered inner layer sub electrodes are respectively coupled with said first electrode and said second electrode are at least 1.3 times thicker than other sections.

5. The chip PTC thermistor as defined in claim 1, wherein said first electrode is a first side electrode disposed on one side face of said conductive polymer, and said second electrode is a second side electrode disposed on the other side face of said conductive polymer.

6. A method of manufacturing a chip PTC thermistor comprising:

a) an integrated sheet forming process in which conductive polymer sheets having PTC properties and at least three conductor sheets are alternately laminated and then integrated;

b) an opening forming process in which an opening is formed on a predetermined position of said integrated sheet in order to make a cross section of a sectioned part of an inner electrode, which is a conductor sandwiched between said conductive polymer, at least 1.3 times larger than cross sections of other parts; and c) an electrode forming process in which an electrode electrically coupled with said conductor exposing from said opening is created.

7. The method of manufacturing a chip PTC thermistor as defined in claim 6, wherein said conductor is a metallic foil.

8. The method of manufacturing a chip PTC thermistor as defined in claim 6, wherein said opening is created by applying shearing force on said integrated sheet.

9. The method of manufacturing a chip PTC thermistor as defined in claim 6, wherein said opening is created by dicing.

10. The method of manufacturing a chip PTC thermistor as defined in claim 6, wherein said opening has a shape of one of a strip and a comb.

* * * * *